US005197160A

United States Patent [19]

Smith

[11] Patent Number: 5,197,160

[45] Date of Patent: Mar. 30, 1993

[54] CLEANING DEVICE FOR CLEANING CARPETS

[76] Inventor: Alexander L. Smith, 24, Terragone, Kirkland, Quebec, Canada, H9J 1R6

[21] Appl. No.: 822,711

[22] Filed: Jan. 21, 1992

[30] Foreign Application Priority Data

Feb. 4, 1991 [GB] United Kingdom ..... 9102381

[51] Int. Cl.[5] ..... A47L 5/38

[52] U.S. Cl. ..... 15/306.1; 15/345

[58] Field of Search ..... 15/308, 306.1, 309.1, 15/345, 346, 347

[56] References Cited

U.S. PATENT DOCUMENTS

| | | | |
|---|---|---|---|
| 407,309 | 7/1889 | Warsop et al. | 15/308 |
| 3,107,386 | 10/1963 | Mandin | 15/345 |
| 3,268,942 | 8/1966 | Rossnan | 15/346 |
| 3,489,607 | 1/1970 | Babcock | 15/346 X |
| 4,003,226 | 1/1977 | Holdsworth | 15/308 X |
| 4,594,749 | 6/1986 | Waterman | 15/345 |

*Primary Examiner*—Stephen F. Gerrity

*Attorney, Agent, or Firm*—Roland L. Morneau

[57] ABSTRACT

A plurality of nozzles is mounted inside a casing for projecting air jets through adjacent rows of stiff and upwardly projecting bristles of a carpet for dislodging lint between the bristles. The lint which is projected out of the bristles is sucked away through an aperture in the casing. The casing is manually or automatically moved over the carpet. The nozzles are characterized by hollow cylindrical needles extending between the bristles and are dimensioned to prevent lateral shifting of the bristles.

6 Claims, 4 Drawing Sheets

CLEANING DEVICE FOR CLEANING CARPETS

BACKGROUND OF THE INVENTION

1. Field of the Invention

The invention relates to a cleaning device for carpets having long stiff bristles and more specifically used on moving conveyors adapted to support garments to be cut to size by an automatic garment cutter.

The cleaning device is particularly made of a casing containing air blowing nozzles adapted to project air through the bristles for dislodging debris between the bristles. The casing is provided with an aperture on which a suction device is connected for channeling the debris out of the casing after they have been dislodged by the nozzles.

2. Prior Art

Garment cutters are known to operate with a moving carpet having long upstanding bristles which supports a piece of cloth and which will be automatically cut to the predetermined dimensions by a cutting head. It is well known that debris such as lint coming from the cut garments are introduced between the bristles which becomes clogged and prevents proper operation of the cutting head. The carpet forming the conveyor is generally made of a plurality of adjacently mounted elementary surfaces provided with bristles. These elements are individually removed and shaken with the bristles pointing downwardly so as to eliminate lint logged in between.

Another known method for cleaning the carpets provided with long upstanding bristles consists in using a strong vacuum cleaner having a suction opening adapted to glide over the upper end of the bristles. The efficiency of such a system is limited when the bristles are relatively long and when the lint and debris are clogging the interstices between the bristles.

SUMMARY OF THE INVENTION

The cleaning device according to the present invention comprises a casing having a top wall and a peripheral wall adapted to sit on the surface of the bristles. A set of elongated nozzles are secured inside the casing and are adapted project between the bristles of the carpet to be cleaned. The nozzles are adapted to project air between the bristles for dislodging the debris therebetween. The casing is additionally provided with an aperture adapted to be connected to a suction device. After the debris and lint have been dislodged by air jets coming from the nozzles reaching the bottom of the bristles, they are sucked out of the casing through the aperture provided in the casing.

The nozzles are preferably angularly oriented to project the debris and lint in the direction of the suction device. The nozzles are preferably provided with needles staggeredly disposed in rows in order to penetrate between adjacent rows of bristles without laterally shifting them.

The casing, which may be freely supported by the tip of the bristles, may also be contemplated as a part of the garment cutter and secured to the cutter carriage disposed over the cover.

DETAILED DESCRIPTION OF THE INVENTION

Figures 1, 2:
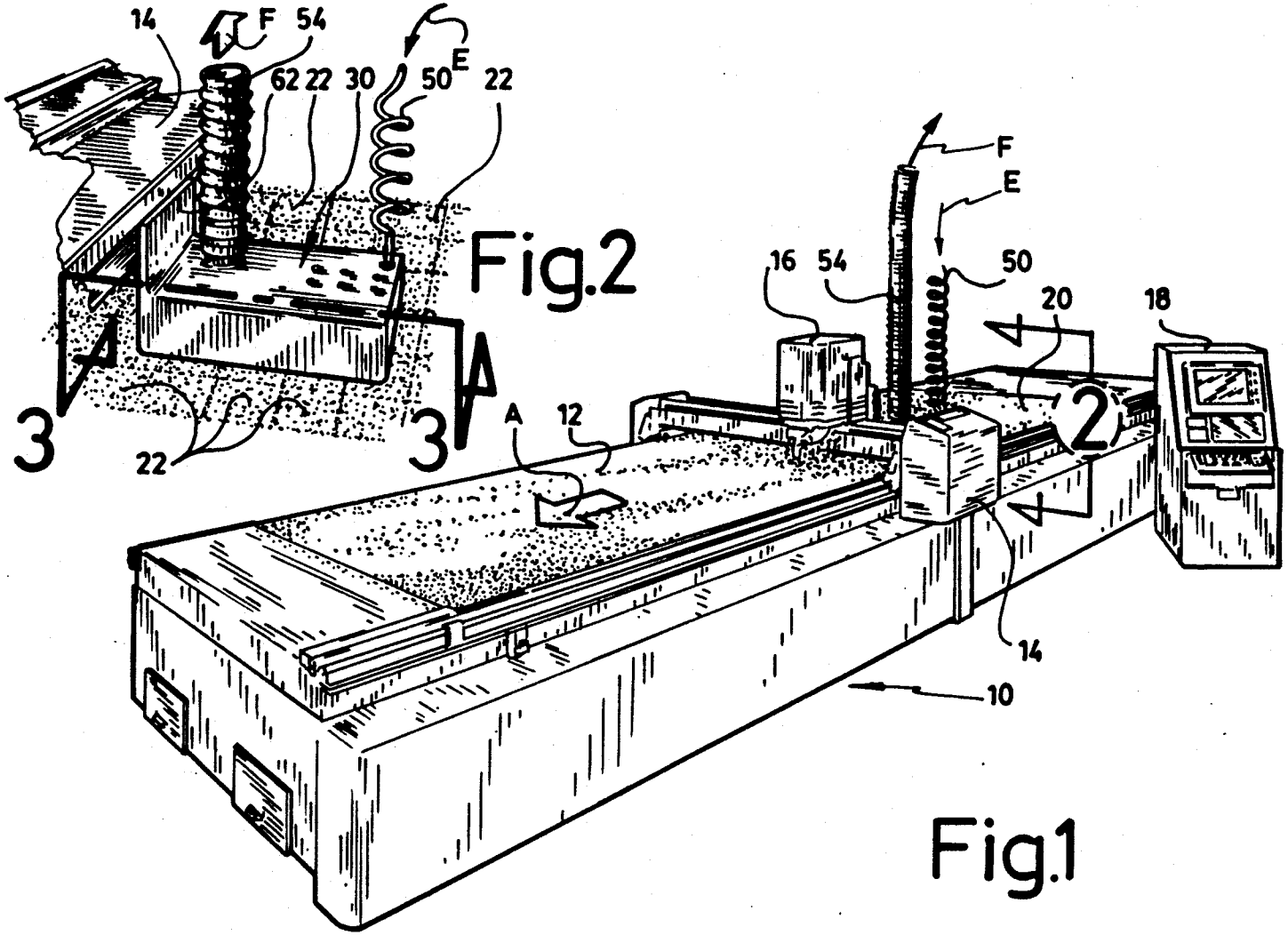
FIG. 1 is a perspective view of a garment cutter on which is mounted a cleaning device according to the invention.
FIG. 2 is a side view of the cleaning device taken along arrows 2 shown in FIG. 1.

FIG. 1 illustrates a garment cutter 10 having a conveyorized cutting table 12, a cutter carriage 14, a cutting head 16 and a computer control 18 for automatically operating the cutter carriage 14 and the cutting head 16.

The cutting table 12 is formed by a travelling carpet moving in the direction of the arrow A. The fabric to be cut is laid on the table 12 located in the front 20 of the cutter carriage 14. When the fabric moves along with the moving carpet under the cutter carriage 14, the cutting head 16 is automatically operated to cut the fabric according to a predetermined design. A knife located inside the cutting head penetrates through the carpet of the cutting table 12.

Figure 4:
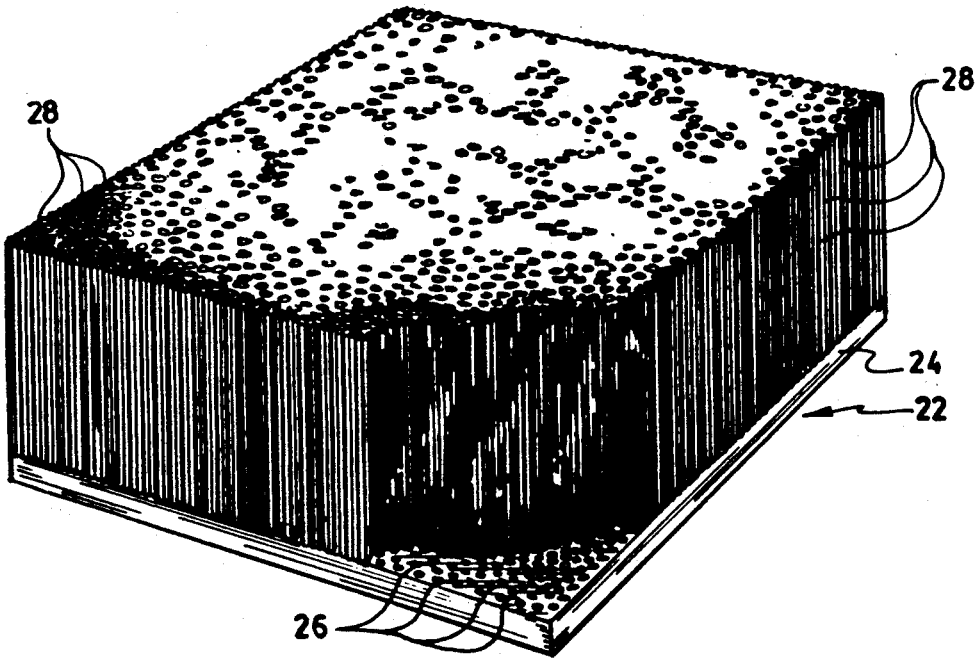
Fig.4 (PRIOR ART)
FIG. 4 is a perspective view of a square of a bristle carpet according to the prior art, with part of the bristles removed to illustrate the perforated base.
Figure 5:
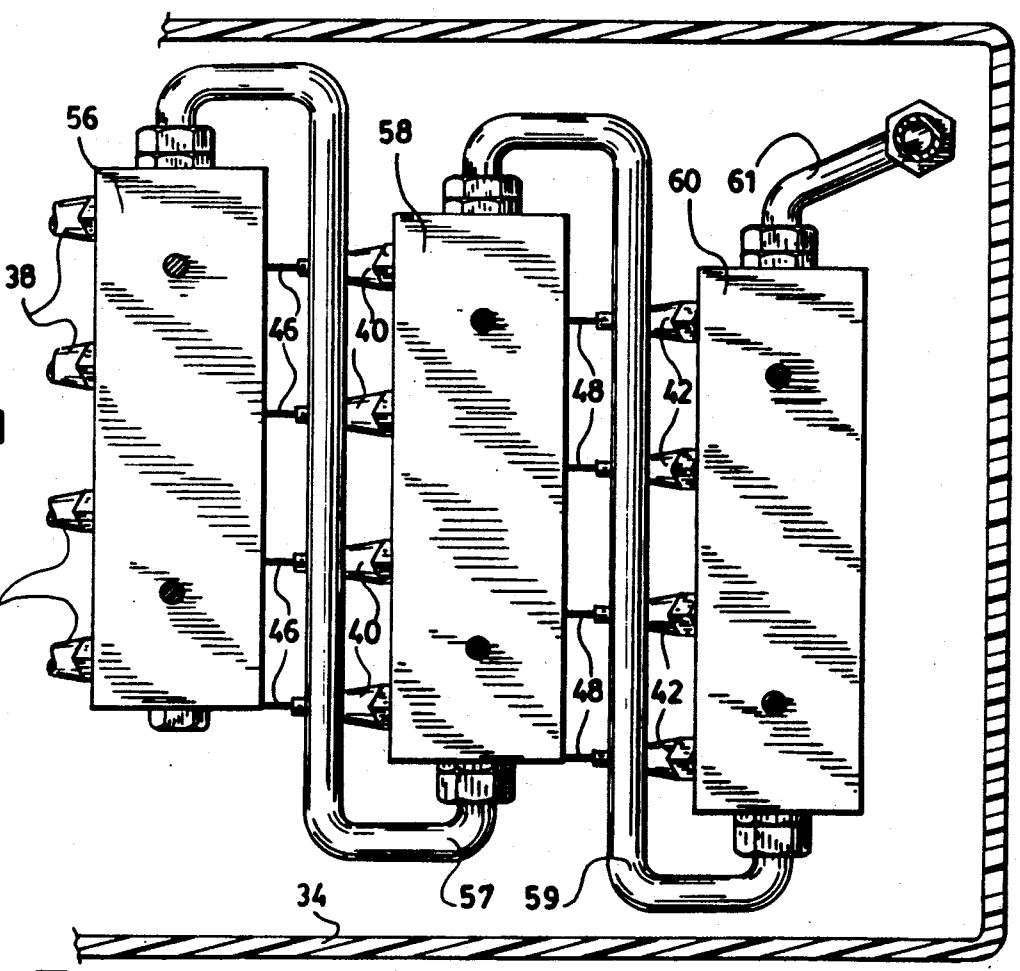
FIG. 5 is a cross-sectional view taken view along line 5—5 of FIG. 3.

The carpet forming the cutting table 12 is generally formed of a plurality of square pieces 22 as shown in FIG. 4. Such pieces 22 of the carpet are adjacently positioned as shown in FIG. 2. Each piece has a square or rectangular contour that is formed of a solid but flexible base 24 which is perforated by a multiplicity of holes 26 and which supports a multiplicity of upstanding stiff bristles 28. The bristles 28 are fixed to the base 24 so as not to interfere with the holes 26. The holes 26 and the bristles 28 are each separated by a distance of about ⅛ of an inch. All the bristles have equal length of about 1¼ inch which forms on the platform of the cutting table 12, i.e. a completely flat surface on which the textile is laid flat.

Such known garment cutters 10 are provided with a suction system under the base 22 of the carpet so as to compress the fabric against the top end of the bristles and prevent any motion while being driven under the cutting head 16. The knife which cuts the fabric extends through and in between the bristles. The latter offer no resistance to the knife considering that they easily spread apart to make way for the knife.

It is well known that lint and dust are accumulated between the bristles, such lint coming from the fabric being cut. Furthermore, it is possible that small portions of the bristles may be cut by the knife in the cutting head 16 and would subsequently drop between the bristles. In order to maintain the integrity of the bristle surface and ensure full vacuum force, a periodic cleaning of the cutting table, that is, the interstices between the bristles must be cleaned. Foreign material between the bristles leads to the tilting of the bristles which may produce the shifting of the supported fabric and the splitting of the bristles themselves.

In order to maintain thc carpet of the cutting table satisfactorally clean, a cleaning device 30 is positioned over the surface of the bristles as shown in FIG. 2.

Figure 4A:
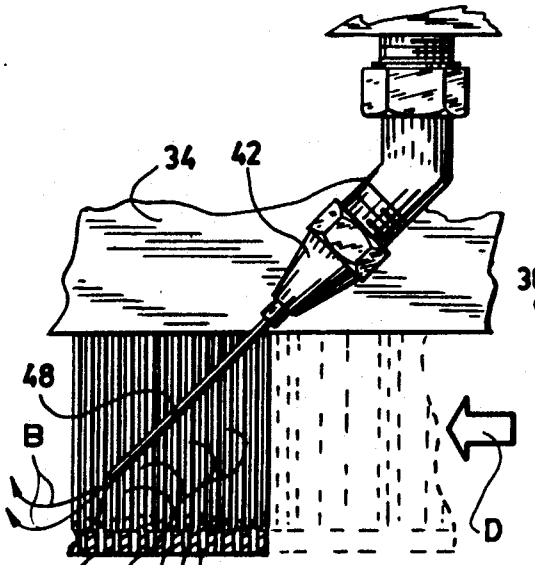
FIG. 4a is an enlarged view of encircled portion 4a shown in FIG. 3.
Figure 6:
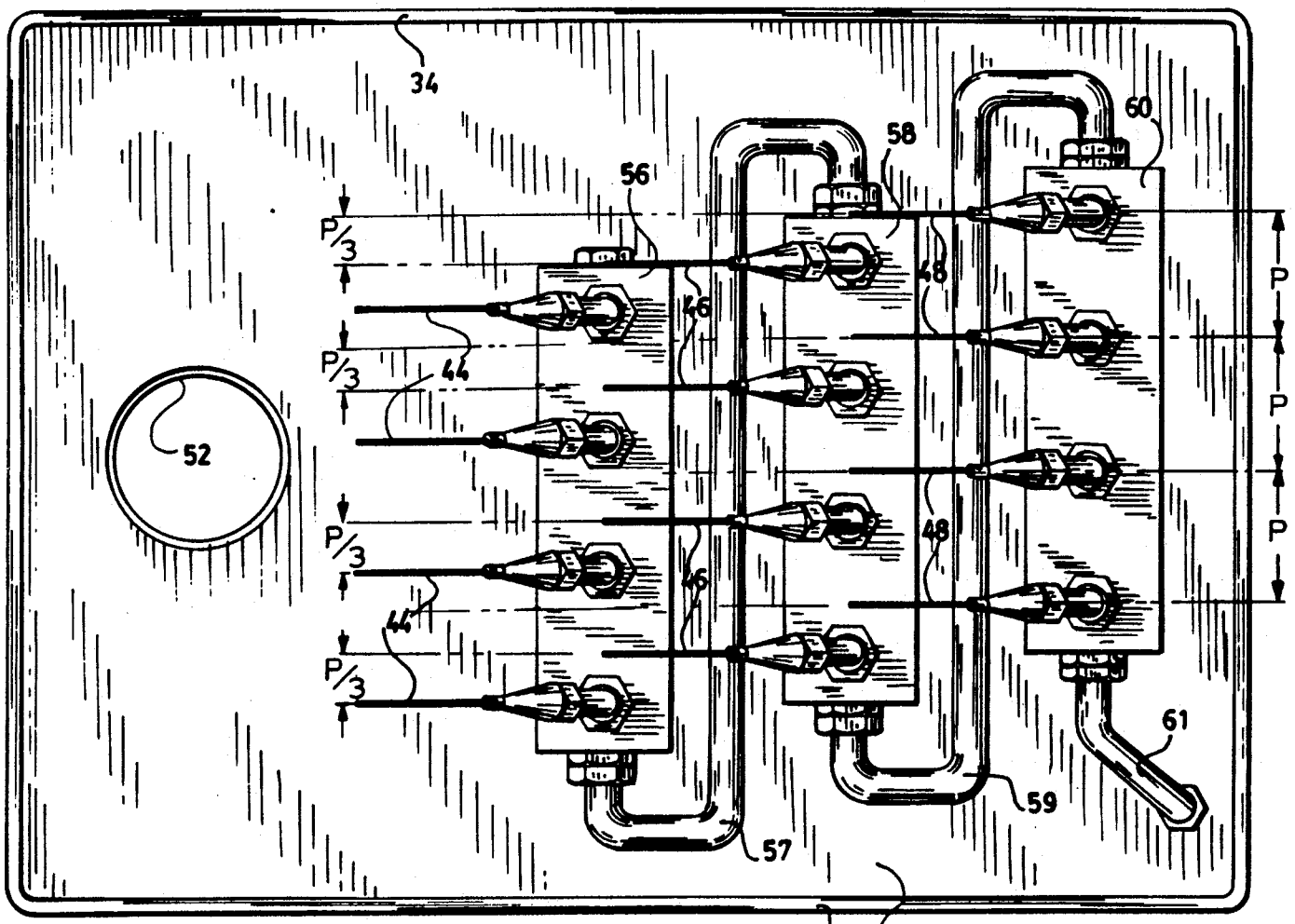
FIG. 6 is a bottom view of the cleaning device taken along 6—6 of FIG. 3.

The cleaning device 30 includes a top wall 32 and a peripheral wall 34 having a wide lower edge adapted to sit evenly on the top of the bristles 28. A plurality of nozzles 38, 40 and 42 are mounted inside the casing of the cleaning device 30. Perforated needles such as 44, 46 and 48 are fixed at the end of the nozzles 38, 40 and 42 respectively for penetrating between the bristles 28 of the carpet piece 22, as particularly shown in FIG. 4*a*. These nozzles are connected through tube 61 to an air pressure system coming through a feeding cable 50. The air which is projected between rows of bristles 28 adjacent the base 24 has a tendency of projecting upwardly in the direction of the arrow B the lint and debris which are lodged at the bottom of the bristles. Such an upward direction of the debris is particularly obtained by an inclination of the needles such as 44, 46 and 48, such inclination being about between 30 and 60 degrees.

The carpet pieces 22 forming the carpet moves in the direction corresponding to the inclination of the needles 44, 46 and 48 so as to allow the latter to glide smoothly between the bristles 28. Once the lint and debris have been evacuated from the bottom of the bristles 28, they are projected in the direction of the arrow B. The casing 30 is provided with an aperture 52 through its top wall 32 at a location corresponding to the direction of the needles 44–48. Accordingly, a suction device 54 essentially corresponding to a household vacuum cleaner is mounted on the aperture 52 for sucking out in the direction F the debris which have been projected in the direction of the arrow B. The inclination of the needles 44–48 favors a continuous flow of the debris between the arrows D and the arrows C.

The fact that the lower edge 36 of the peripheral wall 34 abuts against the top surface of the bristles 28, an enclosure is formed by the casing 30 and preferably sucks air which are coming within the perimeter of the casing 30.

In order to juxtapose the needles 44, 46 and 48 as closely as possible and consequently in order to project air through adjacent rows of bristles 28, the needles are mounted on three successive pressure boxes 56, 58 and 60 interconnected by tubular members 57 and 59. A set of four needles is mounted on each of the boxes. Four needles 44 are mounted on box 56, four needles 46 are mounted on box 58 and four needles 48 are mounted on box 60. The needles 48 are staggeredly mounted relative to the needles 46 and the latter are staggeredly mounted relative to the needles 44 in such a way as the distance P between two adjacent needles 48 which is equal to the distance between adjacent needles 46 and 44 will split such distance P in three equal parts to allow the bristles 28 to be penetrated at a distance of P/3. It has been found that the distance of about one inch between two adjacent needles such as 48, can provide a suitable jet stream to dislodge the lint and debris from the bottom of the needles 28. The needles may reach up to a distance of ⅛ of an inch from the base 24. The needles have an outer diameter for allowing them to glide through the adjacent rows of bristles without any undesirable shifting of the bristles. The needles are cylindrical and have an outer diameter equal or smaller than the distance between adjacent rows of bristles.

The cutting table which has a dimension of about 16 feet long, six feet wide moves along a cyclical path at a speed of about five to six rotation in ten minutes. The complete carpet has a surface of about 300 square feet made of a multiplicity of carpet pieces 22 having a dimension of four square inches.

The vacuum system which maintains the fabric on the surface of the bristles exerts a compression of about 80 to 100 pounds per square inch while a household vacuum cleaner may be established at about 2 inch of mercury. The cleaning device according to the invention is preferably operated when the suction system under the cutting table is not in operation so as to facilitate the removal of the lint and dust which may have hardened at the bottom of the bristles.

Figure 3:
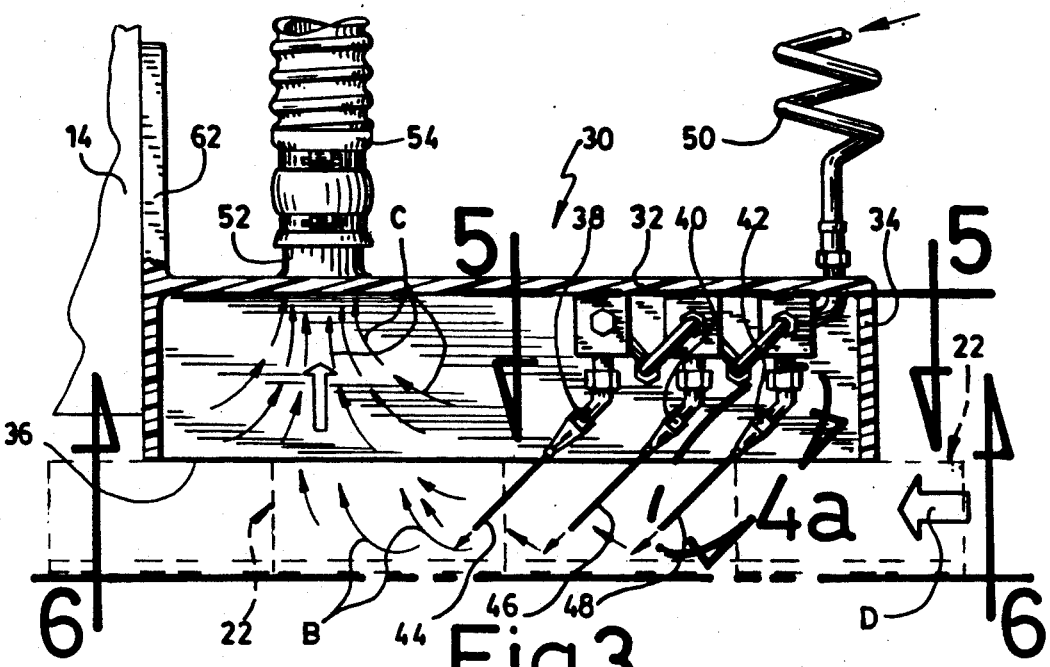
FIG. 3 is a cross-sectional view of the cleaning device taken along line 3—3 of FIG. 2.

The cleaning device 30 may be hand held and moved over the surface of the cutting table 12 but is preferably abutted against the side of the cutter carriage 14 by a lateral wall 62 extending above the peripheral wall 34. The cutting table formed by the carpet pieces 22 moves in the direction of the arrow D shown in FIG. 3 and accordingly maintains the abutment between the wall 62 and the cutter carriage 14.

I claim:

1. A cleaning device for removing debris from between a plurality of adjacent rows of vertically upstanding stiff bristles of a carpet of a garment cutting table, said carpet having a perforated base surface holding the bristles upwardly projecting from said surface, said bristles having a top end defining a flat horizontal resting surface, said cleaning device comprising, a casing having a top wall and a peripheral wall defining a peripheral edge adapted to sit on said resting surface of said bristles, a set of elongated nozzles adapted to be connected to an air blower, a hollow cylindrical shaped needle fixed to each nozzle downwardly projecting inside said casing and extending below said peripheral edge, said needles having an outer diameter for projecting between adjacent rows of said bristles without substantial shifting of the bristles, said nozzles adapted to project air through said needles between said bristles for dislodging said debris between said bristles, said casing being provided with an aperture adapted to be connected to a suction device, whereby said debris are sucked out of said casing through said aperture after they have been removed from between the bristles.

2. A cleaning device as recited in claim 1, wherein said hollow needles are angularly oriented relative to said peripheral edge, said aperture being located in said top wall and in a direction relative to said needles, corresponding to the angular orientation of the needles, whereby said debris are adapted to be projected in the direction of said aperture.

3. A cleaning device as recited in claim 2, wherein said needles are about 1½ inches long and angularly oriented at about 30 to 60 degrees relative to the peripheral edge.

4. A cleaning device as recited in claim 2, wherein said needles are disposed along a plurality of rows, said needles being staggered from one of said rows to another for penetrating between said rows of bristles.

5. A cleaning device as recited in claim 2, wherein the outer diameter of the needles is equal or smaller than a distance separating adjacent rows of said bristles.

6. In a garment cutter having a moving conveyor provided with a carpet travelling in a direction, said carpet being perforated and made of a plurality of rows of upstanding stiff bristles for supporting garments, a cleaning device for removing debris from between said bristles, said device comprising, a casing having a top wall and a peripheral wall defining a peripheral edge adapted to sit on top of said bristles, said casing mounted across said direction of said carpet, a set of nozzles adapted to be connected to an air blower, a hollow cylindrical-shaped needle fixed to each nozzle projecting downwardly below said peripheral edge, said needles having an outer diameter for moving between said adjacent rows without substantial shifting of said bristles for disloding said debris, said needles being angularly oriented relative to the peripheral edge of the casing and in a direction corresponding to the direction of said carpet, said casing being provided with suction means, said suction means being connected to said casing at a location relative to said needles corresponding to said angular orientation of the needles, whereby said debris are dislodged from said carpet, by said needles and projected in the direction of said suction means for cleaning said carpet.

* * * * *